United States Patent [19]

Stange et al.

[11] 4,003,568

[45] Jan. 18, 1977

[54] FLUID CONVEYER

[75] Inventors: Klaus K. Stange, Pittsford; Richard E. Smith, Webster; Thomas J. Hamlin, Macedon; James R. Cassano, Penfield, all of N.Y.

[73] Assignee: Xerox Corporation, Stamford, Conn.

[22] Filed: Dec. 8, 1975

[21] Appl. No.: 638,589

[52] U.S. Cl. ..... 271/225; 271/184; 271/194; 271/195; 271/236

[51] Int. Cl.[2] ..... B65H 5/00

[58] Field of Search ..... 271/225, 185, 184, 236, 271/239, 245, 194, 195

[56] References Cited

UNITED STATES PATENTS

| | | | |
|---|---|---|---|
| 3,473,800 | 10/1969 | Nystrand | 271/184 X |
| 3,705,413 | 12/1972 | Cronquist | 271/195 X |

*Primary Examiner*—Richard A. Schacher
*Attorney, Agent, or Firm*—James J. Ralabate; Carlos Nieves

[57] ABSTRACT

Apparatus for transporting and cooling toner bearing sheets discharged from a fuser includes a structure having a pair of superposed sheet passageways, the entrance to the passageways being located at one end of the structure. The structure is moved so that successive sheets from the fuser are alternately fed to the passageways and fluidic means move the sheets through the passageways and out of the structure, the directions in which a sheet travels in entering and leaving the structure being, generally, orthogonal.

11 Claims, 3 Drawing Figures

FLUID CONVEYER

The subject invention generally relates to conveyers and, in particular, to conveyers suitable for handling articles bearing tacky substances.

Within recent years, the simultaneous use of heat and pressure has become popular in the field of xerography to fuse toner images on copy sheets and typical apparatus for performing this function is disclosed in U.S. Pat. No. 3,539,161, issued on Nov. 10, 1970, to J. F. Byrne. More specifically, this patent discloses the use of a pair of rollers providing a nip, one of the rollers being heated, to fix toner on a sheet passing through the nip with heat and pressure. The sheet passing through the nip is deposited on a conveyer which discharges the sheet into a collecting tray where successive sheets are stacked. With such apparatus, when sheets are initially discharged from the nip the toner on the sheets is fixed but is in a tacky state. Therefore, with a selected rate for moving sheets through the fuser, a length is selected for the conveyor such that as sheets are conveyed a predetermined amount of time elapses and the toner hardens. As a result, when sheets are deposited on the tray, no mutual adherence is experienced. Obviously, the rate at which sheets are fed may be increased if the length of the conveyor is increased or if some means are provided for cooling sheets on the conveyer. The invention herein provides an alternative way of handling toner bearing sheets discharged from a fuser.

It is an object of the present invention to provide fluidic apparatus for simultaneously cooling and transporting toner bearing sheets.

It is another object of the present invention to provide fluidic apparatus for simultaneously cooling and transporting toner bearing sheets, the sheets being moved into the apparatus in one direction and being discharged therefrom in a transverse direction.

Briefly, the invention provides apparatus for transporting and cooling toner bearing sheets discharged from a fuser. Structurally, the apparatus includes (a) a structure having a pair of superposed sheet passageways, the entrance to the passageways being located at one end of the structure; (b) means for alternately feeding successive sheets from the fuser into said passageways; and, (c) fluidic means for moving feed sheets towards the other end of the structure and thereafter in a transverse direction out of the structure.

A feature of the invention resides in that when sheets bearing tacky toner are conveyed and cooled with said fluidic means, buckling and curling of the sheets due to moisture gradients is minimized.

Additional objects and features of the invention will become apparent by reference to the following description in conjunction with accompanying drawings, in which.

Figures 1, 2, 3:
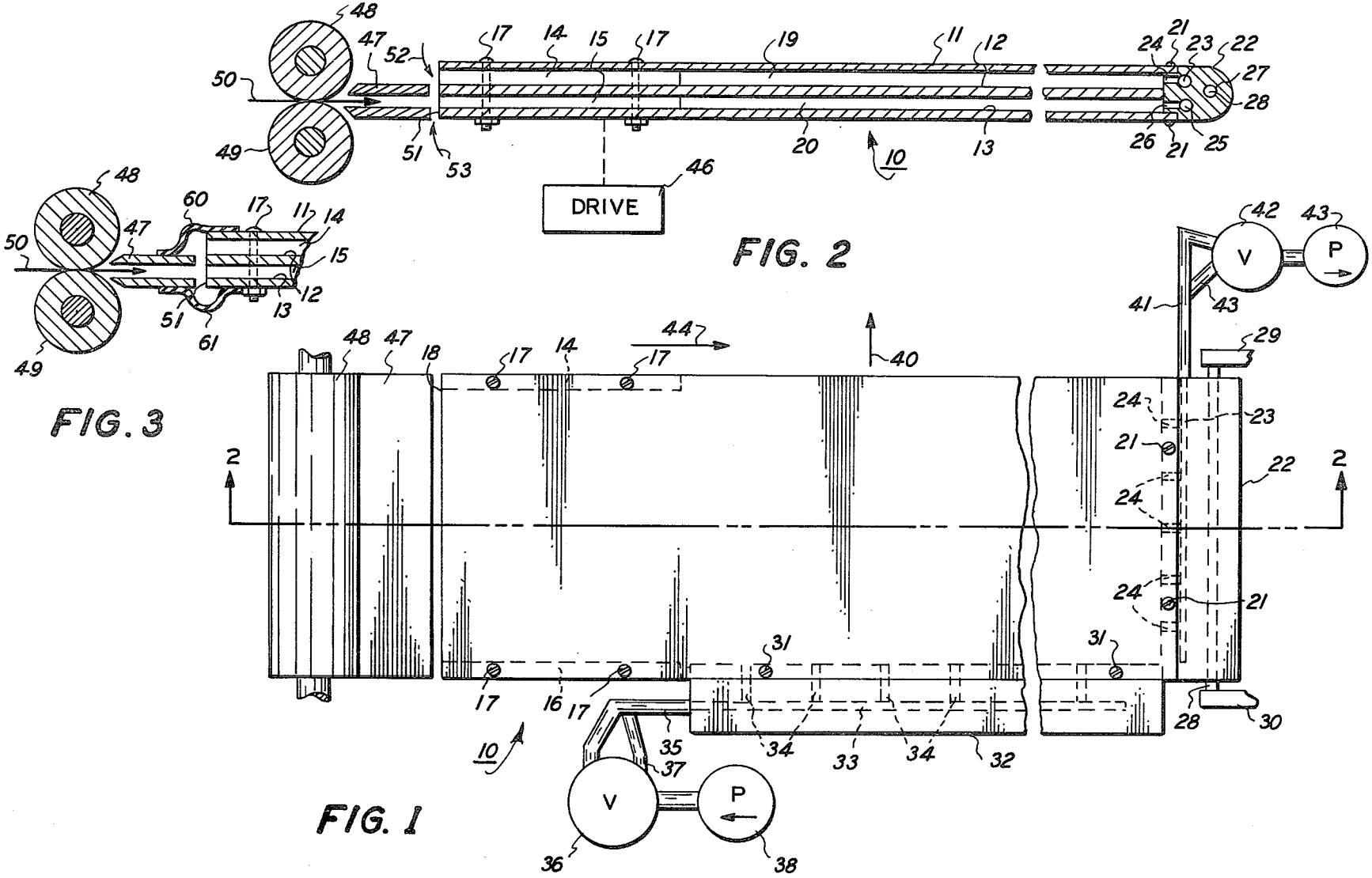
FIG. 1 is a top-plan view of apparatus for transporting and cooling toner bearing sheets discharged from a fuser.
FIG. 2 is a cross-sectional view of the apparatus, taken along line 2—2 in FIG. 1.
FIG. 3 is a partial cross-sectional view of a modification of the apparatus shown in FIGS. 1 and 2.

Referring to FIGS. 1 and 2, an embodiment of apparatus according to the invention includes a structure 10 having three similar rectangular plates 11–13, four elongated spacers 14–16 (not all shown) and fasteners 17. The plates are vertically aligned and each pair of adjacent plates is separated by a pair of spacers extending in parallel from adjacent corners at one end 18 of the structure. The fasteners extend through the plates and spacers to secure the structure, thereby providing passageways 19 and 20 which, typically, are about one-sixteenth of an inch high. At the other end of the structure there is secured by a plurality of screws 21 a dual chamber manifold 22, one chamber 23 of the manifold communicating, via a plurality of holes 24, with passageway 19 and the other chamber 25 of the manifold communicating via another plurality of holes 26 with passageway 20. Manifold 22 also includes a hole 27 through which a rod 28 supported by brackets 29 and 30 extends to, as more fully described below, pivotally support the structure. On a side of the structure there is secured by a number of screws 31 a dual chamber manifold 32, one chamber 33 of the manifold communicating, via a plurality of holes 34, with passageway 19 and another chamber (not shown) communicating via another plurality of holes with passageway 20. Chamber 33 is coupled by a flexible tube 35 to a valve 36 and the other chamber of manifold 32 is separately coupled by another flexible tube 37 to valve 36. In turn, valve 36 is coupled to a pump 38. Valve 36 alternately provides fluid from the pump to the chambers and the fluid flows in the direction indicated by arrow 40 either through passageway 19 or passageway 20. Chamber 23 is coupled by a flexible tube 41 to a valve 42 and chamber 25 is separately coupled by flexible tube 43 to valve 42. Valve 42 is coupled to a vacuum pump 43 and is alternately actuated to draw fluid in the direction indicated by arrow 44 either through passageway 19 or passageway 20. Structure 10 is alternately pivoted, about rod 28, by a drive 46 so that either passageway 19 or 20 is in alignment with a sheet guide 47 positioned adjacent a pair of fuser rolls 48 and 49, such as are more fully disclosed in the referenced U.S. Pat. No. 3,539,161.

Operatively, with passageway 20 aligned with guide 47 a first toner bearing sheet is moved as indicated by arrow 50 in FIG. 2. When the sheet enters passageway 20 it is drawn into abutment with manifold 22 by a vacuum established in chamber 25 by valve 42 and pump 43. As the first sheet travels down the passageway 20 drive 46 moves the structure so that passageway 19 is aligned with guide 47. When the first sheet is in abutment with the manifold 22 valve 42 switches the vacuum pressure to chamber 23 and a second sheet is drawn down passageway 19. As the second sheet is drawn pump 38 supplies, via valve 38 and tube 37, a fluid flow which drives the first sheet out of the structure in the direction indicated by arrow 40. After the second sheet is in passageway 19 the structure is moved to align passageway 20 with guide 47. As a third sheet is fed into passageway 20, the second sheet is brought into abutment with manifold 22 and is discharged in the direction of arrow 40 by fluid coupled to chamber 33 by valve 36. Thus, it may be seen that the valves 42 and 36 and the drive 46 are synchronized to move sheets periodically supplied along directions 44 and 40. Sheets so handled are cooled by the fluids which drive them through the structure and may be collected in a tray (not shown) positioned adjacent to the structure. The cooling action prevents mutual adherence between sheets stacked in the tray.

Drive 46 may be implemented in a number of ways by those skilled in the art. For example, the drive may be a driven cam which is followed by the structure or may include an electromagnetic arrangement. If desired, a sensor (not shown) such as an electric eye, may be used to sense the entrance of a sheet into a passageway, signals from the sensor being useful to control the drive 46 and valves 36 and 42.

It should be noted that a gap 51 exists between the guide 47 and the structure and that when air is being drawn through manifold 22 fluid enters one of the passageways through the gap as is indicated by arrows 52 and 53. This flow does not interfere with sheets fed and minimizes any flow in the immediate area of the rollers 48 and 49. As a result, the rollers are not cooled and less heat is required to maintain the rollers at a fusing temperature. However, if the guide 47 and plates 11 and 13 are coupled, as shown in FIG. 3, with flexible members 60 and 61, fluid enters the structure through the end of the guide plates adjacent the rollers and the fluid flow advantageously tends to strip sheets away from the fuser rolls.

It is to be understood that the description herein of a preferred embodiment, according to the invention, has been set forth as an example thereof and is not to be construed or interpreted to limit the claims which follow and define the invention.

What is claimed is:

1. Apparatus for transporting and cooling toner bearing sheets discharged from a fuser, comprising:

a. a structure having a pair of superposed sheet passageways, the entrance to the passageways being located at one end of the structure;

b. means for alternately feeding successive sheets from the fuser into said passageways; and, c. fluidic means for moving fed sheets toward the other end of the structure and thereafter in a transverse direction out of the structure.

2. Apparatus as defined in claim 1 wherein said means for alternately feeding includes a guide through which sheets are fed, and means for alternately aligning the entrance of the passageways with the guide.

3. Apparatus as defined in claim 2 wherein the structure is pivotally mounted and wherein said means for aligning include means for alternately pivoting the structure.

4. Apparatus as defined in claim 1 wherein said fluidic means includes a manifold located at the other end of the structure, the manifold having a first chamber communicating with one of the passageways and a second chamber communicating with the other of the passageways; and means for alternately providing a vacuum pressure in the chambers.

5. Apparatus as defined in claim 4 wherein said fluidic means further includes a second manifold, located on a side of the structure, the second manifold having a chamber communicating with said one of the passageways and a chamber communicating with said other of the passageways; and means for alternately providing pressurized fluid in the chambers of the second manifold, in each passageway pressurized fluid or vacuum pressure being applied in the alternative.

6. Apparatus as defined in claim 5 wherein said vacuum pressure draws fluid through the passageways in a direction which is transverse to the direction in which fluid is injected into the passageways.

7. Apparatus as defined in claim 6 wherein said means for alternately providing a vacuum pressure includes a vacuum pump and a valve for alternating pressure from the pump between the first and second chambers.

8. Apparatus as defined in claim 7 wherein said means for alternately providing pressurized fluid in the chambers of the second manifold includes a pressure pump and a valve alternatively providing fluid to the chambers of said second manifold.

9. Apparatus as defined in claim 5 wherein said means for alternately feeding includes a guide through which sheets are fed, and means for alternately aligning the entrance of the passageways with the guide, vacuum pressure being supplied to an aligned passageway and fluid being injected to the unaligned passageway.

10. Apparatus as defined in claim 9 wherein the structure is pivotally mounted and wherein said means of aligning include means for alternately pivoting the structure.

11. Apparatus as defined in claim 1 wherein said means for alternately feeding includes a guide positioned adjacent the discharge end of the fuser and means for alternately aligning the entrance of the passageways with the guide; and wherein said fluidic means include flexible means coupling the structure to the guide and means for providing fluid flow through the guide and alternately through the passageways.

* * * * *